US008522371B2

(12) United States Patent
Bevan et al.

(10) Patent No.: US 8,522,371 B2
(45) Date of Patent: Sep. 3, 2013

(54) DUMP BUCKET TANK INSERT FOR NEW AND USED TOILETS

(76) Inventors: Glenn E. Bevan, Holden, MO (US); Ryan D. Saffels, Harrisonville, MO (US)

( * ) Notice: Subject to any disclaimer, the term of this patent is extended or adjusted under 35 U.S.C. 154(b) by 831 days.

(21) Appl. No.: 12/655,775

(22) Filed: Jan. 7, 2010

(65) Prior Publication Data

US 2011/0099702 A1 May 5, 2011

Related U.S. Application Data

(60) Provisional application No. 61/280,325, filed on Nov. 2, 2009.

(51) Int. Cl.
*E03D 1/02* (2006.01)

(52) U.S. Cl.
USPC ..... 4/365; 4/363

(58) Field of Classification Search
USPC ..... 4/353, 363, 365; 222/160, 164, 222/167; 248/130, 131
See application file for complete search history.

(56) References Cited

U.S. PATENT DOCUMENTS

| | | | | | |
|---|---|---|---|---|---|
| 426,165 | A * | 4/1890 | Brittin | 141/339 |
| 577,021 | A * | 2/1897 | Groszmann | 4/365 |
| 644,882 | A * | 3/1900 | Wangelin | 4/365 |
| 675,491 | A * | 6/1901 | Mann | 4/365 |
| 1,358,218 | A * | 11/1920 | Kosminsky | 141/339 |
| 1,613,640 | A * | 1/1927 | Bartosik | 4/365 |
| 5,666,674 | A | 9/1997 | Hennessy | |
| 5,887,293 | A | 3/1999 | Hennessy | |
| 6,317,899 | B1 * | 11/2001 | Brewer | 4/365 |
| 6,611,967 | B1 | 9/2003 | Hennessy et al. | |
| 2008/0006375 | A1 * | 1/2008 | Meadows | 160/371 |

* cited by examiner

*Primary Examiner* — Gregory Huson
*Assistant Examiner* — Erin Deery
(74) *Attorney, Agent, or Firm* — John C. McMahon

(57) ABSTRACT

A tank insert for converting a conventional flush toilet into a flapperless, dump bucket-style toilet. The tank insert is sized and shaped to be snugly received within a water tank of the toilet, and includes a water reservoir pivotably received within a catch basin. The water reservoir is filled by the toilets water valve and the toilet's handle actuates the water reservoir to flush the toilet. Upon actuation, water within the water reservoir is discharged into the catch basin, and from there into the toilet bowl, which is effectively cleared.

27 Claims, 5 Drawing Sheets

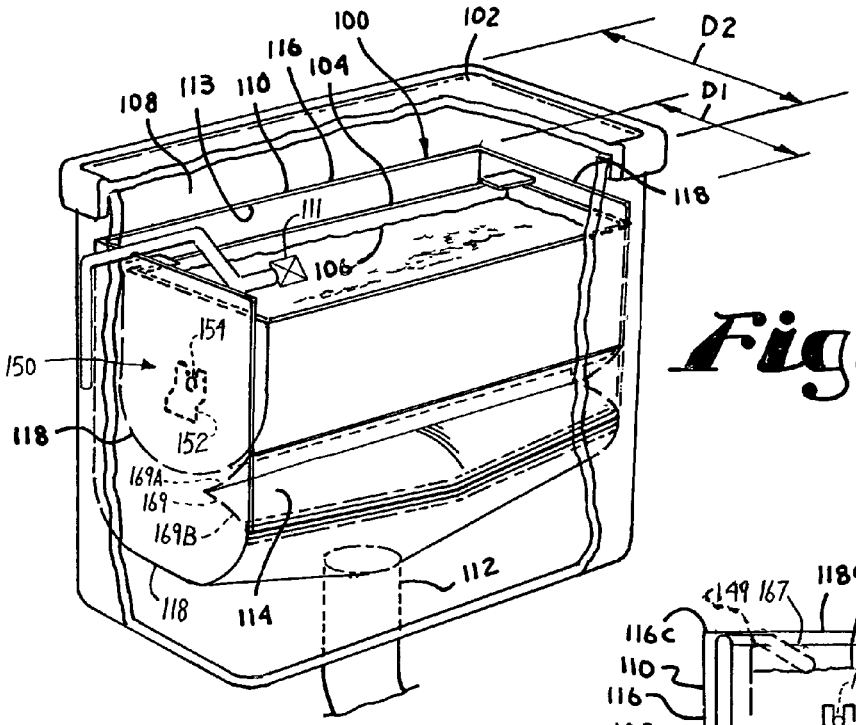
Fig.1.
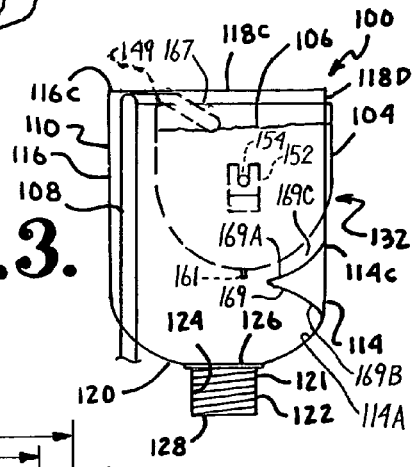
Fig.3.
Fig.2.
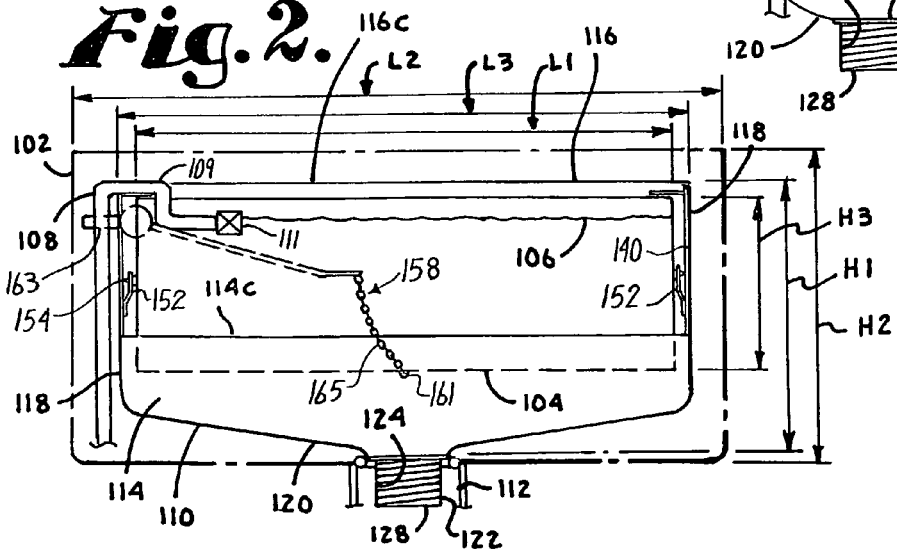

Fig. 9.
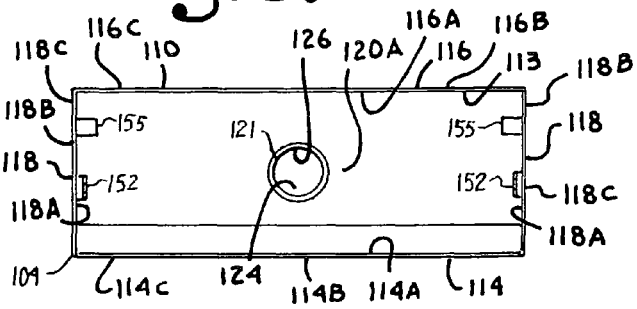
Fig. 10.
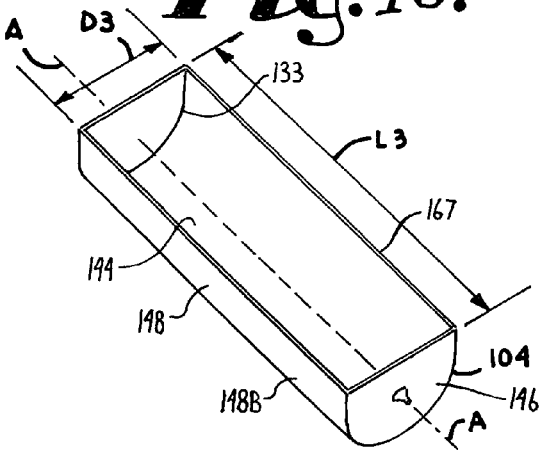
Fig. 11.
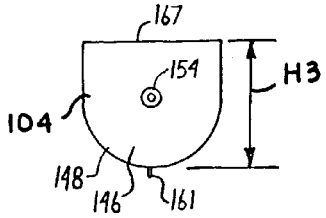
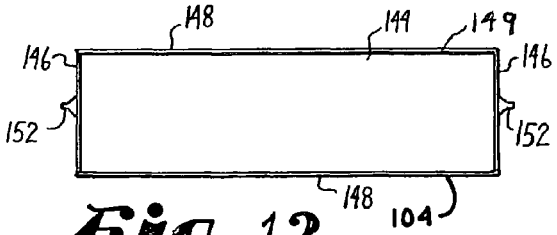
Fig. 12.
Fig. 13.
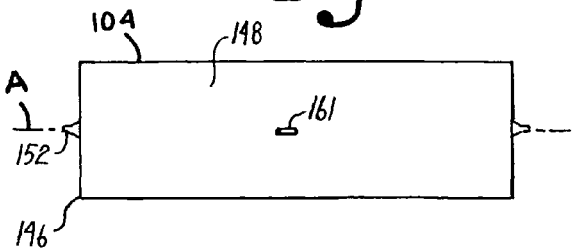

DUMP BUCKET TANK INSERT FOR NEW AND USED TOILETS

CROSS-REFERENCE TO RELATED APPLICATIONS

This application claims the benefit of U.S. Provisional Patent Application Ser. No. 61/280,325, filed Nov. 2, 2009 and incorporated by reference herein.

BACKGROUND OF THE INVENTION

The present invention is directed towards devices, methods and kits for converting or retrofitting a conventional flush toilet to a water-saving, dump bucket-style flapperless flush toilet; especially towards a toilet tank insert, for use with used conventional flush toilets, but which can also be used with a new, water saving, dump bucket style, flapperless toilet.

In recent years, many areas have experienced severe water shortages. As a result, water conservation has become an important issue. Unfortunately, in the U.S. and many other locations, most currently installed toilets include conventional flush valve and flapper systems that leak frequently and consume large quantities of water. The chemicals used to treat water often deteriorate the flappers so they leak and conventional flush toilets manufactured prior to 1994 use at least 3.5 gallons of water per flush. In contrast, some modern, low-flow toilets use between 0.8 and 1.6 gallons of water per flush.

Conventional flush toilets are subject to a variety of malfunctions, especially slow water leaks, caused by the above noted deterioration, that may not be noticed by the homeowner until an excessive volume of water has been wasted. In a related problem, since conventional flush valves and toilets are not manufactured for accuracy or precision, they often have inaccurate, variable flush volumes. During some flushes, because the tank was under filled, the volume of water used is insufficient to clear the bowl, requiring a second flush and wasting water. During other flushes, too much water is used because the tank was over filled.

External connections on toilets may also leak and seep water on the floor. This can be further exacerbated by the tendency of a conventional flush toilet's water tank to sweat, because the temperature of the water in the tank is lower than that of the ambient air, causing the water to collect and drip on the floor.

Since water use and conservation is such an important issue, many areas require that approved water-saving toilets be installed in new building construction and that homeowners replace older, already installed toilets with such water-saving toilets. Currently, California requires homeowners to replace their older, conventional flush toilets with new toilets that use 1.6 gallons of water per flush or less. This saves about 25-gallon of water per day, for the average household.

Unfortunately, water-saving toilets that actually flush effectively in comparison to the amount of water used tend to be expensive, which puts them out of reach of much of the population. Further, more affordably-priced water-saving toilets tend to be poorly designed and require extra flushes to clear the bowl. Therefore, there is a need for an affordable, efficient and effective water-saving flushing device that can be installed in existing conventional flush toilets and in new toilets.

SUMMARY OF THE INVENTION

In accordance with one embodiment of the present invention, a tank insert for a toilet, comprising a water reservoir including a longitudinal axis of rotation, wherein the water reservoir is sized and shaped to receive a quantity of water from a fill valve system of the toilet and having a dump side; and a catch basin sized and shaped to be received snugly within a water tank of the toilet and including an upper interior portion adapted to pivotably receive the water reservoir therein, a lower interior portion sized and shaped to receive the quantity of water from the water reservoir, and an inwardly extending splash guard mounted on an interior surface of the catch basin beneath the water reservoir opposite the water reservoir dump side, the splash guard being adapted to substantially direct water exiting the water reservoir toward the lower interior portion; a mounting subassembly adapted to pivotably attach the water reservoir to said upper interior portion; and an actuation subassembly adapted for pivoting the dump side of the water reservoir along the longitudinal axis of rotation, so as to discharge the quantity of water from the water reservoir and into the lower interior portion.

In a further embodiment, the tank insert includes a water outlet located in the lower interior portion. The water outlet is adapted for fluid communication between the lower interior portion and a flush channel of the toilet.

In another further embodiment, the splash guard is inwardly bowed.

In another further embodiment, the splash guard includes a concave upper surface and a concave lower surface. In a still further embodiment, the concave upper surface includes a curve substantially equal to a curved outer surface of the water reservoir.

In another further embodiment, the water reservoir includes an interior defined by a pair of opposed generally upright U-shaped side walls and a continuous facing wall.

In another further embodiment, the reservoir is trough-shaped.

In another further embodiment, the quantity of water is about 1.6 gallons or less.

In another further embodiment, the quantity of water is about 1.28 gallons or less.

In another further embodiment, the water reservoir is adapted to discharge an amount of water sufficient to generate a flushing vortex in the toilet.

In another further embodiment, the water reservoir is adapted to receive the water from a fill valve and float system of the toilet.

In another further embodiment, the mounting subassembly includes a pair of brackets, each of the brackets being disposed on one of a pair of opposed interior surfaces of the upper interior portion; and a pair of trunnions disposed on opposed exterior side surfaces of the water reservoir, the trunnions being disposed coaxially with the longitudinal axis of rotation; wherein each of the trunnions is rotatably engaged in one of the brackets. In a still further embodiment, the water reservoir is adapted for discharging the quantity of water into the catch basin upon rotation of the trunnions about the axis of rotation.

In a still further embodiment, the brackets are integral with the interior surfaces.

In another further embodiment, the water reservoir is adapted to pivot from front to rear about the axis of rotation and with respect to the toilet.

In another further embodiment, the water reservoir includes a first position associated with receiving the quantity of water and a second position associated with discharging the quantity of water. In a still further embodiment, when the water reservoir is in the second position, it is rotated approximately 90° about the axis of rotation with respect to the first position.

In another further embodiment, the actuation subassembly includes an eyelet located on a bottom exterior surface of the water reservoir, the eyelet being adapted for attachment to a chain attached to a flush handle of the toilet.

In another further embodiment, the eyelet is adapted for pulling by the chain when the handle is actuated, such that simultaneously the eyelet is moved forward and upward with respect to the toilet and an upper opening of the water reservoir is tilted rearward and downward with respect to the toilet.

In another further embodiment, the catch basin includes a basin floor having opposed front and rear edges, a pair of opposed side edges, and a water outlet; wherein the basin floor includes at least one slope selected from the group consisting of: a downward slope from at least one of said front, rear and side edges towards an opposed edge; and a downward slope from at least one of the front, rear and side edges towards a central portion of the floor; wherein the water outlet is lower than the basin floor with respect to the toilet.

In a still further embodiment, the downward slope includes an angle optimized for efficient toilet flushing.

In a still further embodiment, the basin floor is generally funnel-shaped.

In a second embodiment of the present invention, a method of converting a toilet with a flapper valve flush system to a flapperless toilet is provided. The method includes the steps of removing the flush valve and flapper system from the toilet tank; inserting a dump bucket insert into the toilet tank; fluidly connecting the dump bucket insert to a flush channel of the toilet; fluidly connecting a water reservoir of the dump bucket insert to a fill valve of the toilet; and connecting the water reservoir of the dump bucket insert to a flush handle of the toilet, whereby actuation of the flush handle tilts the water reservoir.

In a further embodiment, the step of inserting the dump bucket insert into the toilet tank includes inserting a catch basin into the toilet tank; and installing a water reservoir into the catch basin such that a curved outer surface of the water reservoir is in spaced relationship with an inwardly bowed splash guard.

In a third embodiment of the present invention, a kit for retrofitting an installed flapper-flush toilet is provided. The kit includes a tank insert as recited in the first embodiment; and a set of instructions for performing the method as recited in the second embodiment.

OBJECTS AND ADVANTAGES OF THE INVENTION

Therefore, the following are objects of the present invention; however, it is noted that certain of the objects may not apply to all of the various embodiments of the invention including enabling significant water saving by providing a simple and inexpensive device for easily converting a conventional flush toilet, which likely includes a flapper flush valve, to a low-water-using, dump bucket-style toilet; reducing consumer costs by offering an affordable alternative to toilet replacement; reducing greenhouse gases by reducing the amount of raw materials and energy used to manufacture, ship and install replacement toilets; reducing the number of used toilets that end up in landfills; and providing a flush mechanism that is easy to use and especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a toilet tank insert according to the present invention, wherein the tank insert is installed in a tank of a pre-existing toilet and portions are cut away to show detail thereof.

FIG. 2 is a reduced front elevational view of the tank insert of FIG. 1, wherein the tank insert is installed in the tank of the toilet that is shown in phantom.

FIG. 3 is a reduced side elevational view of the tank insert of FIG. 1, with the water reservoir in a first position or configuration.

FIG. 9 is a reduced top plan view of the catch basin of FIG. 6.

FIG. 10 is a reduced perspective view of a water reservoir of the tank insert of FIG. 1.

FIG. 11 is a reduced side elevational view of the water reservoir of FIG. 10.

FIG. 12 is a reduced top plan view of the water reservoir of FIG. 10.

FIG. 13 is a reduced bottom plan view of the water reservoir of FIG. 10.

DETAILED DESCRIPTION OF THE INVENTION

Figure 4:
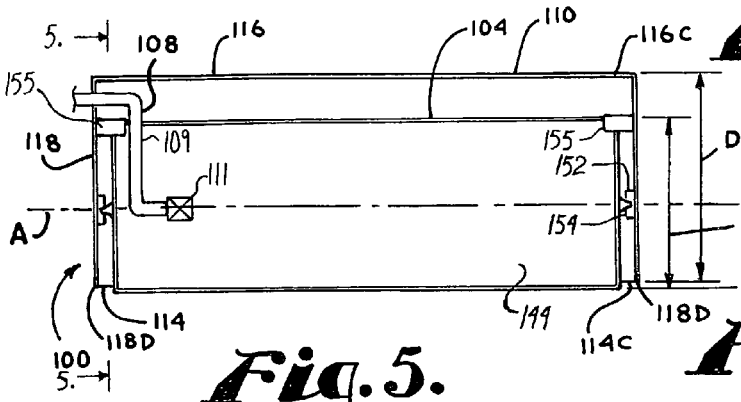
FIG. 4 is another reduced side elevational view of the tank insert of FIG. 1, with the water reservoir in a second position or configuration.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to FIGS. 1-13, a tank insert for converting a conventional flush toilet into a dump bucket toilet is denoted by the numeral 100. The term "conventional flush toilet" as used herein is a broad term, and is to be given its ordinary and customary meaning to a person of ordinary skill in the art (and it is not to be limited to a special or customized meaning), and refers without limitation to a flushing toilet that includes a flush valve with a flapper or ball to close the flush channel and an overflow tube, and/or which is adapted to normally use a large volume of water to clear the toilet bowl, for example, more than about 1.6 gallons.

The tank insert 100 is inserted (e.g., placed) into the water tank 102 of a conventional flush toilet, such as to convert (e.g., retrofit) a new, uninstalled flush toilet or a currently installed conventional flush toilet into a dump-bucket toilet, so as to reduce water usage when flushing the toilet compared to a conventional flush toilet. The tank insert 100 includes a water reservoir 104 that receives water 106 from the toilet's water fill system 108, and a catch basin 110 that is fluidly connected to the toilet's flush channel 112. To flush the toilet, the water 106 is discharged from the water reservoir 104 into the catch basin 110. From the catch basin 110, the water 106 flows out to the toilet's flush channel 112, and into the toilet bowl so as to flush or clear the toilet bowl.

Referring to FIGS. 1 and 2, the device 100 (e.g., catch basin 110) is sized and shaped to be received snugly within the toilet water tank 102. For example, the catch basin 110 includes a longitudinal length L1, which is at least slightly shorter than a longitudinal length L2 of the toilet tank 102. Similarly, the device 100 (e.g., the catch basin 110 plus the water reservoir 104) has a depth D1 which is at least slightly shorter than the toilet tank's depth D2. The catch basin 110 includes a height H1, which is at least slightly shorter than the toilet tank's height H2. Preferably, the height H1 of the catch basin 110 is sufficiently short that a water inlet tubing 109 and with a shut off valve 111 of the toilet's water fill system 108 can fit over the catch basin 110 and be received into the water reservoir 104, which is most easily seen in FIG. 2. The valve 111 can be any conventional valve that senses a desired resting water level has been acquired in the toilet and thereafter automatically turns off water flowing through the tube 109.

Referring to FIGS. 6-9, the catch basin 110 includes an interior portion 113 defined by opposed front and back walls 114 and 116, a pair of opposed side walls 118, a floor 120, and a neck 122. Each wall 114, 116 and 118 has an interior surface 114A, 116A and 118A, respectively, an exterior surface 114B, 116B and 118B, respectively, and a top edge 114C, 116C, and 118C, respectively. For example, the front wall 114 has interior and exterior surfaces 114A and 1142, and a top edge or lip 114C. Similarly, the back wall 116 includes interior and exterior surfaces 116A and 116B, and top edge 116C; and each side wall 118 includes an interior surface 118A, an exterior surface 118B and a top edge 118C. Similarly, the floor 120 includes an interior surface 120A and exterior surface 120 B. When the catch basin 110 is installed within a toilet tank 102, the front and back exterior surfaces 114B and 116B are adjacent to the tank's front and rear walls, respectively, and the side exterior surfaces 118B are adjacent to the tank's side walls.

Figure 6:
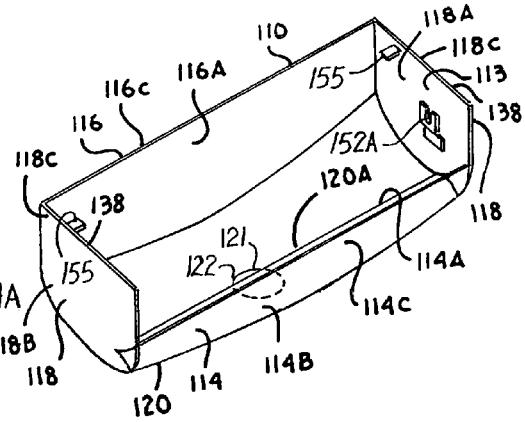
FIG. 6 is a reduced perspective view of a catch basin of the tank insert.

Referring to FIGS. 2-4, 6 and 7, the front wall 114 is substantially shorter than the side and back walls 118 and 116. For example, the front top edge 114C is substantially lower than the side and back top edges 118C and 1160, with respect to the catch basin's neck 122 and with respect to the top of the toilet tank 102 and/or the room floor. Since the walls 114, 116 and 118 are generally joined at their side edges, as illustrated in FIGS. 6 and 9, a generally rectangularly-shaped cut-out portion 132 of the catch basin 110 is defined by the intersection of the front edges 118D (of the side walls 118) and the front wall top edge 114C. As is discussed elsewhere herein, the cut-out portion 132 is sized and shaped to allow passage of the protruding portion of the water reservoir 104, as the water reservoir 104 is rotated to discharge the water 106. As is discussed in greater detail herein and is most easily seen in FIGS. 3 and 4, the water reservoir 104 is located within the catch basin 110, so that at least a portion of the water reservoir 104 extends forward, towards the front of the toilet tank 102, such that a portion of the water reservoir 104 protrudes out of the catch basin 110 (e.g., past front wall 114).

Figure 7:
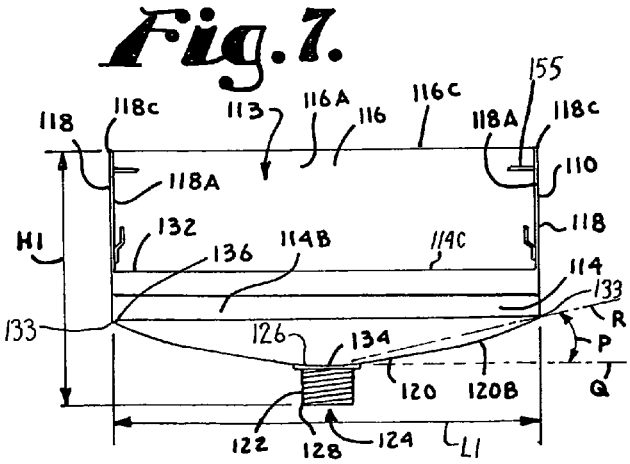
FIG. 7 is a reduced front elevational view of the catch basin of FIG. 6.
Figure 8:
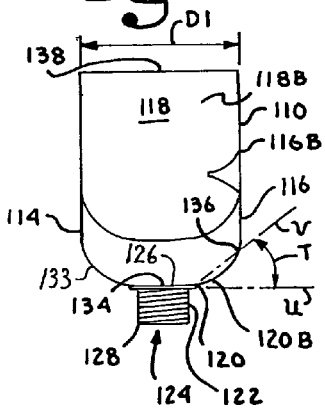
FIG. 8 is a reduced side elevational view of the catch basin of FIG. 6.

Referring now to FIGS. 2-9, the catch basin floor 120 includes interior and exterior surfaces 120A and 120B, and a water outlet 121 or channel. The floor 120 generally curves downward from the walls 114, 116 and 118 to the water outlet 121. In some circumstances, a transition 133 between a floor 120 and an adjacent wall (e.g., where they are joined) is easily demarcated, such as by a corner. In other circumstances, such a transition 133 is not so well demarcated, and includes a curve. For example, a wall can gently curve into the floor such that it is difficult to determine where one structure ends and the other begins. In still other circumstances, the transition 133 is intermediate between a sharp corner and a substantial curve. FIG. 7 illustrates an exemplary transition 133 with a clearly demarcated edge or corner, namely, the transitions 133 between the capture basin's side walls 118 and the floor 120. In contrast, FIG. 8 illustrates an exemplary non-demarcated transition 133, namely, where the front wall 114 joins the curved floor 120 via a curve, instead of a sharp corner.

In preferred embodiments, the walls 114, 116, 118 and floor 120 of the catch basin 110 are integrally formed, such as of injection molded plastic. However, it is foreseen that the walls 114, 116, 118 and floor 120 can be individually formed (e.g., as one or more pieces each) and subsequently joined using techniques known in the art, such as but not limited to welding and adhesives.

The floor 120 is adapted to direct water 106 within the catch basin interior 113 toward the water outlet 121. In some embodiments, at least a portion of the floor 120 is curved from its forward, rear and/or side edges towards the neck 122. In other embodiments, at least a portion of the floor 120 is a plane. Additionally or alternatively, the floor 120 is shaped such that it includes at least one slope. The present invention contemplates the floor 120 including a plurality of sloped planes, including, but not limited to, a first sloped plane from the lower edges of at least one of the front, rear and side walls 114, 116, 118 towards the water outlet 122; and a second sloped plane from the lower edge of another of at least one of the front, rear and side walls 114, 116, 118 towards the water outlet 122 or a centrally-located portion or area of the floor 120.

FIG. 6 illustrates an exemplary floor 120 having a plurality of downward slopes (e.g., flat or curved portions of the floor 120), each slope being oriented from a front, a back or a side wall 114, 116, 118 toward a centrally located water outlet 122. For example, a front portion of the floor 120 slopes from the front wall 114 towards the center of the floor 120 (e.g., towards orifice 126). It is anticipated that, in some circumstances, the floor 120 slopes downward, from front to rear (e.g., with respect to the toilet), from rear to front, or from one opposed side to the other. In preferred embodiments, a water outlet 121 is located at the lowest portion or area of the catch basin floor 120, with respect to the toilet 102, such that the floor 120 directs water 106 to the water outlet 122 and out channel 124. In some embodiments, the water outlet 122 is centrally located and the floor 120 is generally funnel-shaped.

In general, a slope of the floor 120 is associated with and/or is defined by an angle. FIG. 7 shows a first exemplary angle denoted by the letter P. When viewed from the front wall 114 of the catch basin 110, angle P is associated with a slope of the floor 120, from a side wall 118 towards orifice 126. Angle P is defined by lines Q and R. Line Q is parallel to edge 114C, such that it (line Q) intersects with the floor's lowest point 134 (e.g., water outlet 121). Line R intersects both the floor's lowest point 134 and intersection 133 (e.g., the outer "edge" of the floor 120). It is noted that in this example, because this portion of the floor 120 is somewhat curved, line R intersects the floor at only two points (e.g., places).

FIG. 8 shows a second exemplary angle denoted by the letter T. When viewed from the perspective of a side wall 118, angle T is associated with a slope of the floor 120, from the back wall 116 towards orifice 126. Angle T is defined by lines U and V. Line U is parallel to a top edge 138 of side wall 118 and intersects with the lowest point 134 of the floor 120. Line V intersects the lowest point 134 and point 136 (e.g., the intersection of the floor 120 and back wall 116). Line V intersects the floor 120 at only two points because this portion of the floor 120 is substantially curved. The slope of line T is greater than that of line R, since the portion of the floor 120 associated with angle T is more steeply sloped than the portion of the floor 120 associated with angle P. Therefore, angle T is greater than angle P. Additional angles associated with additional slopes of the floor 120 can be drawn.

It is foreseen that, depending upon the design of the floor 120, the floor 120 can include a plurality of slopes, and therefore a plurality of angles P and T. For example, angles P and T can be relatively greater or smaller, depending upon the design of the floor 120. In some circumstances, the angle is 0°. In an exemplary floor 120, all of the angles equal 0°, such that the floor 120 is flat and parallel to the floor of the room. In some circumstances, the catch basin floor 120 is generally funnel-shaped due to the presence of one or more slopes, such that water 106 is directed out of the catch basin 110. Preferably, the angle of a downward slope (e.g., an angle such as P and/or T) is optimized for efficient toilet flushing. In preferred embodiments, such an angle associated with a slope of the floor 120 is about 2°, 4°, 6°, 8°, 10°, 15°, 20°, 25°, 30°, 35°, 40°, 45° or greater.

A neck portion 122 (e.g., neck) extends downwardly from the floor 120, for fluidly connecting the device 100 with the toilet's flush channel 112 (e.g., forming a fluid communication between the device 100 and the flush channel 112), most commonly be insertion therein. An interior channel 124 (e.g., a water outlet) is located within the neck portion 122, and includes an interior opening or orifice 126 and an opposed exterior opening or orifice 128. The catch basin interior 113 is in fluid communication with the channel 124 via the interior opening 126. The channel 124 is in fluid communication with the device 100 exterior that extends through the flush channel 112 via the exterior opening 128. Thus, the catch basin interior 113 is in fluid communication with the toilet flush channel 112 via channel 124.

In general, when the device 100 is installed in a toilet tank 102, the channel 124 is fluidly connected (e.g., joined) to the toilet's flush channel 112. The terms "fluidly connected" and "fluid communication" as used herein are broad terms, and are to be given their ordinary and customary meaning to a person of ordinary skill in the art (and are not to be limited to a special or customized meaning), and refer without limitation to components or structures being connect or joined in such a way that fluid can flow therebetween. Since channel 124 and flush channel 112 are in fluid communication, the water 106 can flow out of the catch basin 110 and into the toilet flush channel 112 (e.g., when the device 100 is actuated). Generally, as is known in the art, water flows from the flush channel 112, through the toilet bowl, and into a sewer pipe, such that the bowl is cleared. In some circumstances, the fluid connection between the channel 124 and the toilet flush channel 112 (e.g., neck 122) is made by removing the toilet's flush valve (e.g., flapper and overflow tube) and inserting the neck 122 into the flush channel 112. In some circumstances, the device 100 is sized and shaped such that the neck 122 aligns with the flush channel 112 when the device 100 is placed in the tank 102. In some circumstances, the neck 122 is flexible so that it can be pushed into a misaligned flush channel 112 during device 100 installation. In some circumstances, a sealing compound is used to form a seal between the flush channel 112 and the neck 122, using methods and materials known in the art. In some circumstances, additional sealing materials and/or devices (e.g., parts) are provided to create a water-tight seal, such as, but not limited to O-rings, adhesive compound, adhesive tape, Teflon® tape, flashing, and collars.

Referring to FIGS. 1-4 and 10-13, the water reservoir 104 is pivotably received within an upper interior portion 140 of the catch basin 110, such that the water reservoir 104 is spaced above the floor 120. The water reservoir 104 includes an interior portion 144 defined by a pair of opposed side walls 146 and a continuous facing wall 148 having a dump side 149. In some circumstances, the water reservoir side walls 146 are generally upright U-shaped, and the facing wall 148 is attached therebetween. Thus, in these circumstances, the water reservoir 104 is generally trough-shaped, with an outwardly curving facing wall 148. The water reservoir 104 further includes a longitudinal axis of rotation denoted by the letter A. The water reservoir 104 is rotated about (e.g., around) axis A to discharge (e.g., dump) water 106 in the interior portion 144 into the bottom of the catch basin 110, as is discussed in greater detail below.

A mounting subassembly 150, including a pair of brackets 152 and a pair of trunnions 154, pivotably attaches (e.g., supports) the water reservoir 104 is within the upper interior portion 140 of the catch basin 110. The brackets 152 are disposed (e.g., located, mounted) within the catch basin 110, on opposed interior surfaces 118A of walls 118, such that they are coaxial with the longitudinal axis of rotation A. The trunnions 154 are disposed (e.g., located, mounted) on the water reservoir 104, on opposed exterior surfaces of the side walls 146, such that they are coaxial also with axis A. The water reservoir 104 is installed within the catch basin 110 such that each trunnion 154 rotatably engages (e.g., mates with) a corresponding bracket 152, and is still coaxial with axis A. Thus, when the trunnions 154 are engaged in the corresponding brackets 152, the water reservoir 104 can be moved (e.g., rotated) about axis A, between a first position associated with receiving and holding water 106 (see FIG. 3) and a second position associated with discharging the water 106 (see FIG. 4).

An exemplary bracket 152 is shown in FIG. 6. This bracket 152 includes a vertical slot 152A for receiving a trunnion 154. However, any bracket sized and shaped to receive a trunnion 154 can be used. The brackets 152 can be integrally formed with the catch basin 110, or they can be attached after the catch basin 110 has been manufactured, using methods known in the art.

A pair of exemplary trunnions 154 are shown in FIG. 13. The trunnions 154 are located on opposed sides of the reservoir 104, such that they are coaxial with the longitudinal axis of rotation A. Thus, the water reservoir 104 is pivotable about axis A on the trunnions 154, from the first position (FIG. 3) to the second position (FIG. 4), and back again. The trunnions 154 can be integrally formed with the side walls 148 of the water reservoir 104, or they can be attached after the water reservoir 104 has been manufactured. For example, metal pins can be mounted on the exterior surfaces of the side walls 148, using adhesive, rivets, welding, or other attachment structures and/or materials known in the art. In another example, the trunnions 154 include a metal rod extending from the end of one trunnion, through the walls 146 and reservoir interior 144, to the end of the other trunnion.

A pair of stop pins 155 are located within the catch basin 110, such that the pins 155 contact the water reservoir 104 in each of the first and second positions, thereby stopping its rotation about axis A (e.g., clockwise and counterclockwise).

Figure 5:
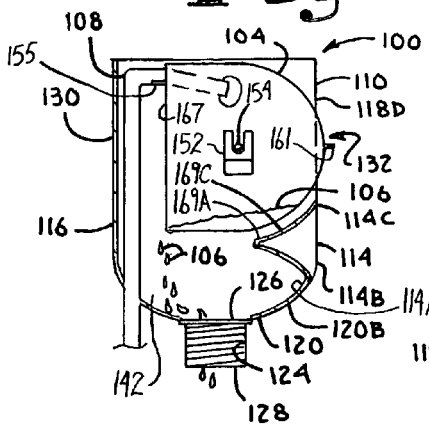
FIG. 5 is a cross-sectional view of the tank insert of FIG. 1, taken along line 5-5 of FIG. 4.

For example, FIGS. 5 and 9 show that the pins 155 are located on interior surfaces 118, such that they are spaced from back wall 116 and the top edges 118C of the side walls 118, and project or extend inwardly, such that extend over at least a rear portion of the water reservoir's side walls 146 (e.g., adjacent to a rear portion of the facing wall 148). In some circumstances, the pins 155 extend at least partially over the rear upper corners of the side and facing walls 146, 148.

Efficient bowl clearing is critical in low-water (e.g., low-flow) flush toilets. Accordingly, such toilets must be carefully designed to maximize flushing efficiency. For example, if a single flush is not sufficient to clear the bowl, then water will be wasted with additional flushes. Accordingly, the tank insert 100 is configured and arranged to optimize toilet flushing. Namely, the insert 100 is configured and arranged to generate a flushing vortex sufficient to clear the bowl, when the toilet is flushed. The term "vortex" as used herein is a broad term, and is to be given its ordinary and customary meaning to a person of ordinary skill in the art (and it is not to be limited to a special or customized meaning), and refers without limitation to a spinning flow of fluid or a spiral motion of fluid with closed streamlines. The speed and rate of rotation of the fluid are greatest at the center, and decrease progressively with distance from the center. Thus, a flushing vortex has a sufficiently high speed and/or rate of rotation to clear the toilet bowl.

Several parameters contribute to effective and/or efficient bowl clearing. These parameters include, but are not limited to, the shape of the floor 120 (described above), the amount of water 106 used per flush, the velocity of the water 106 when it is discharged from the water reservoir 104, the height of the water 106 within the water reservoir 104 with respect to the floor 120, and the diameter of the neck channel 124.

Preferably, the water reservoir 104 is sized and shaped to optimize flushing of the toilet. While not wishing to be bound by theory, it is believed that a trough-shaped water reservoir 104 discharges the water 106 with a greater velocity than a box-shaped reservoir, and therefore enables better toilet bowl clearing. Further, the amount of water 106 is optimized such that the amount of water 106 is sufficient for effective flushing while avoiding water waste. Stated another way, the amount of water 106 sufficient to generate a flushing vortex in the toilet. Thus, depending upon the shape of the water reservoir 104 and its height from the floor 120, in preferred embodiments, the interior portion 144 is sized to receive about 1.6 gallons of water 106 or less. In a more preferred embodiment, the interior portion 144 is sized to receive about 1.28 gallons of water 106 or less. In some embodiments, the interior portion 144 is adapted to receive about 2.0, 1.8, 1.4, 1.3, 1.1, 1.0 or 0.8 gallons of water 106 or less. In preferred embodiments, the amount of water 106 is sufficient to generate a flushing vortex in the toilet, when the toilet is flushed. Referring to FIG. 5, when the water reservoir 104 is in a first position, the pins 155 contact the rear upper corners of the water reservoir 104. When the water reservoir 104 is rotating to the first position (e.g., clockwise), the pins 155 stop the rotation when the upper opening 167 (e.g., a plane defined thereby) is substantially parallel to the room floor, as seen in FIG. 1.

Referring to FIG. 4, when the water reservoir 104 is in the second position, the pins 155 contact the forward upper corners of the water reservoir 104. When the water reservoir 104 is rotating to the second position (e.g., counter clockwise), the pins 155 stop the rotation when the upper opening 167 (e.g., a plane defined thereby) is generally perpendicular to the room floor. It is noted that when in the second position, the bottom most portion of the water reservoir extends out of the catch basin opening 132.

While in preferred embodiments, the device 100 is configured such that the water reservoir 104 pivots from front to rear (e.g., with respect to the toilet or to the room floor) about the axis of rotation A, it is foreseen that the device 100 can be configured such that, when the device 100 is installed in a toilet tank 102, the water reservoir 104 pivots in the opposite direction, from rear to front. For example, the device 100 can be configured such that it is installed backwards (e.g., with reference to FIGS. 1-14), such that the catch basin's front wall 114 is adjacent to the toilet tank's rear wall.

The device 100 includes an actuation subassembly 158, for pivoting the water reservoir 110 about the longitudinal axis of rotation A, so as to discharge (e.g., dump) the water 106 from the water reservoir 110 (e.g., the interior portion 144) and into the catch basin 110 (e.g., the lower interior portion 142). The actuation subassembly 158 includes at least an eyelet 161 for connecting the water reservoir 104 to the toilets handle 163. The eyelet 161 is located on a bottom exterior surface of the water reservoir 104. For example, referring to FIGS. 2 and 3, an exemplary eyelet 161 is attached to the lowest portion of the facing wall 148, approximately half-way between the opposed side walls 146 (e.g., ½ L3). It is foreseen that the eyelet 161 can be attached at other locations on the facing wall 148, such as but not limited to a location closer to the forward portion of the facing wall 148.

As shown in FIG. 2, the eyelet 161 is attached to the toilet's flush handle 163, such as by a chain 165, string or cord. In some embodiments, the actuation subassembly 158 is provided (e.g., sold as a kit) with a flush handle 163 and/or a chain 165 included (e.g., a new handle 163 and chain 165). In other embodiments, the actuation subassembly 158 includes only the eyelet 161, and the toilet's old handle 163 and/or chain 165 are connected to the device's 100 actuation subassembly 158 (e.g., eyelet 161).

When the toilet is flushed (e.g., the flush handle 163 is actuated), the eyelet 161 is moved (e.g., pulled via chain 165) forward and upward with respect to the toilet bowel 102. This causes the water reservoir 104 to move from the first position (FIG. 3) to the second position (FIG. 4) by rotating the trunnions 154 within the brackets 152, about axis A. Stated another way, when the toilet is flushed, the actuation subassembly causes the water reservoir 104 to rotate counter clockwise about 90° (e.g., when viewed from the perspective of FIGS. 3 and 4), about axis A. In some embodiments, this counter clockwise rotation is stopped when the forward upper edge of the water reservoir 104 hits stop tabs 155, as described elsewhere herein. Simultaneously, as the upper opening 167 (e.g., of the water reservoir 104) is tilted rearward and downward with respect to the toilet (e.g., the room floor), water 106 within the interior portion 144 is discharged (e.g., dumped) into the catch basin 110 lower interior portion 142 (e.g., FIG. 4, indicated by the water droplets 106). When the water 106 is discharged into the lower interior portion 142, a flushing vortex is generated. The water 106 flows from the lower interior portion 142, through the neck 122, channel 124, and into (e.g., out, through) the toilet's flush channel 112. After the water has been discharged, the water reservoir returns to the first portion by rotating about 90° clockwise about axis A. In some embodiments, this clockwise rotation is stopped when the rear upper edge of the water reservoir 104 hits the stop tabs 155.

As water is discharged from the water reservoir 104 and contacts the floor 120, a portion of the water 106 flows (e.g., splashes) upwards along the catch basin interior front surface 114A, towards opening 132. To prevent the water from splashing out of the opening, an inwardly and laterally extending splash guard 169 is disposed (e.g., located, mounted) on the catch basin's front interior surface 114A, adjacent to edge 114C (see FIGS. 1, 3 and 4). The splash guard extends inwardly from the front interior surface 114A, along the length of the front 114, and includes both upper and lower convex surfaces 169A and 169B, respectively. In some embodiments, the front wall 114 is inwardly bowed, such as shown in FIG. 1. In other embodiments, such as shown in FIGS. 3 and 4, the front wall 114 is a plane, including a substantially flat interior surface 114A, and the splash guard 169 is attached to the interior surface 114A.

The upper surface 169A is spaced from the outer surface 148B of the water reservoir 104 and includes a curvature that is adapted such that as the water reservoir 104 moves between the first and second positions (e.g., FIGS. 3 and 4), the outer surface 148B does not contact the upper surface 169. For example, in some embodiments, the upper and lower convex surface 169A, 169B are radiused surfaces. Thus, the radius of the upper convex surface 169A may be equal to or greater than the radius of the curvature of the bottom of the water reservoir 104.

Even though the space 169C between the splash guard upper surface 169A and the water reservoir outer surface 148B is large enough such that movement of the water reservoir 104 is not substantially blocked by the proximity of the splash guard 169 to the water reservoir 104, the space 139C is sized such that it is sufficiently small (e.g., narrow) enough to substantially block water 106 from splashing out of the catch basin cut-out portion 132 (e.g., front opening) is substantially blocked. In some circumstances, such as wherein the eyelet is located on the bottom of the water reservoir 104, the space 169C is sufficiently large that the eyelet 161 (or a chain 158 connected to the eyelet) does not contact the upper surface 169A. Alternatively, the eyelet 161 may be located in an indentation or well located in the outer surface 148B of the water reservoir 104, such that eyelet 161 does not extend or protrude from or past the level of the outer surface 148B.

In addition to preventing water 106 from splashing out of the device 100, the splash guard 169 is sized and shaped to redirect the flow of water 106 moving upward along the front inner surface 114A back towards the lower interior portion of the catch basin 110, such as but not limited to towards the opening 134 in the floor 120. Accordingly, the lower surface 169B of the splash guard 169 is concave or radiused. Thus, when the water 106 is discharged and contacts (e.g., hits, runs into) the floor 102, some of the water flows or splashes up along surface 114A and then moves along the lower concave surface 169B. As the splashing water 106 moves along the lower concave surface 169B, the water 106 is directed backward and downward, and falls towards the floor 120 and the interior orifice 126. Thus, substantially little water 106 splashes towards space 169C. Consequently, the water 106 discharged into the catch basin 110 substantially does not splash out of the device 100, when the toilet is flushed.

Figure 14:
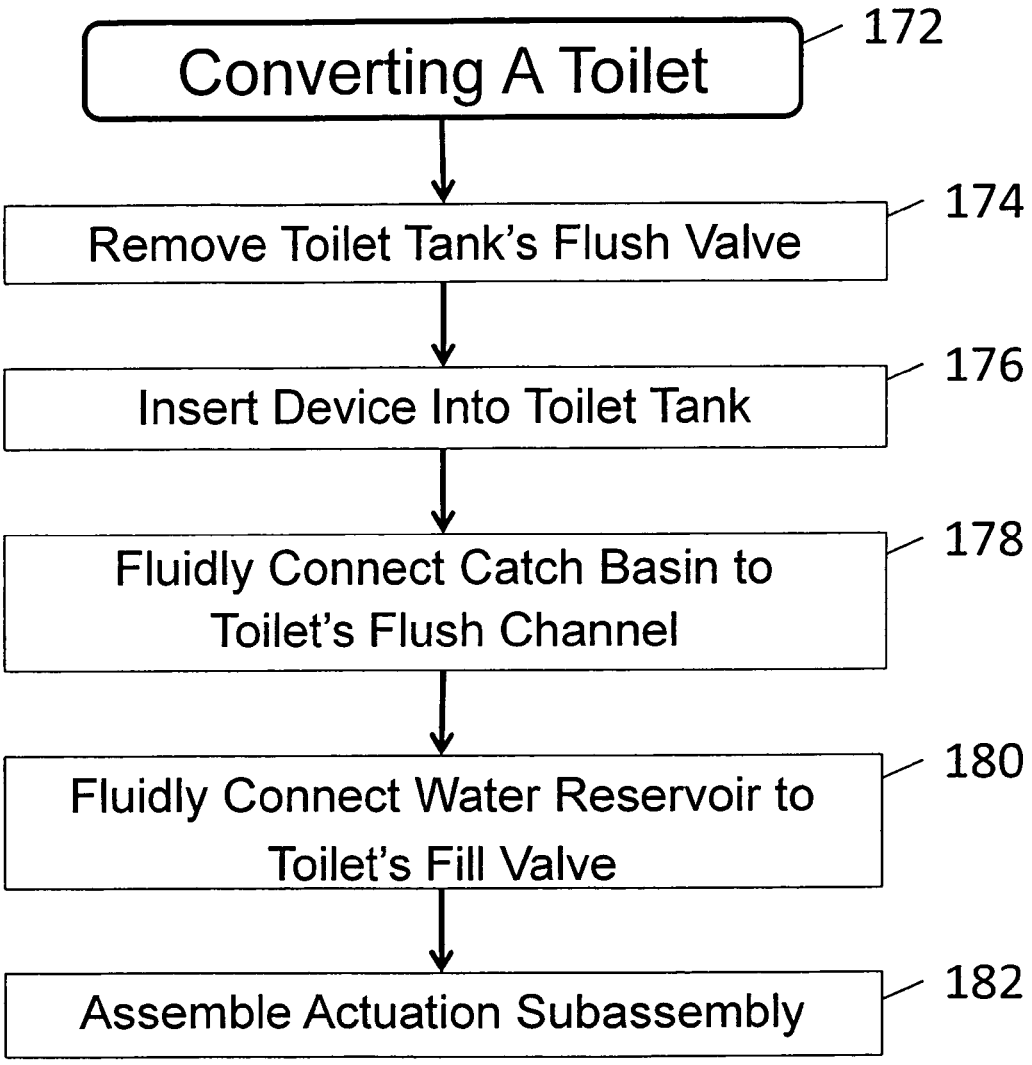
FIG. 14 is a flow diagram of a method of installing the toilet insert of FIG. 1.

FIG. 14 is a flow diagram illustrating a method of converting a toilet with a flapper valve flush system to a low-flow toilet, such as a flapperless toilet. This method is denoted by the numeral 172, and includes a plurality of steps.

At box 174, the toilet's flush valve system (e.g., including a flapper associated with the flush channel 112) is removed. This step is performed using tools and methods known in the art. Prior to installing the device 100, the water supply to the toilet is turned off. Then, water in the toilet tank 102 is drained, and the connector holding the flush valve system in place is disconnected (e.g., unscrewed) with a wrench. Upon removal, the flush valve system is thrown away. If the water fill system is not suitable for use with the dump tank, then the water fill system is also removed and replaced with a new fill system and/or valve when required.

At box 176, the device 100 (e.g., a dump bucket toilet tank insert) is inserted (e.g., placed) into the toilet tank 102.

At box 178, the catch basin 110 is fluidly connected to the toilet's flush channel 112. For example, in some circumstances, the device's neck portion 122 is simply inserted into the flush channel 112, such that water flowing out of the neck 122 flows directly into the flush channel 112 (e.g., the interior channel 124 is in fluid communication with the flush channel 122). In some further circumstances, a plumbing compound and/or tape is used to attach the neck 122 to the flush channel 112, such that a water-tight seal is formed. A variety of connection devices and methods known in the art can be used, such as welding, bolts, washers and nuts, O-rings, sealing tape, adhesives, and the like.

At box 180, the water reservoir 104 is fluidly connected to the toilet's water fill system 108. Conventional (toilet tank) fill system 108 generally include a float, water supply tubing, and a valve 111 that is actuated by the raising and lowering of the float. To connect the fill system 108, the water supply tubing is moved to the side or back of the device 100 (e.g., between the device 100 and the toilet tank's wall). The tubing of the fill system 108 is placed over the wall (e.g., side or rear) of the water reservoir 104, such that the fill valve is disposed within the water reservoir 104 at a height suitable to control filling the reservoir 104 with a desired quantity of water 106. For example, the float is placed in the water reservoir 104, and functions as it would in a conventional flush valve system known in the art. In a further example, when the water 106 level (e.g., in the water reservoir 104) is low, the float actuates opening the fill valve, and water 106 flows into the water reservoir 104. As water 106 accumulates in the water reservoir 104, the float rises with the water level. When the float reaches its desired maximum level within the water reservoir 104, the float actuates closing the fill valve, and the water flow is turned off (e.g., terminated, stops). As is known in the art, the maximum level or height of the float can be adjusted, such that a desired amount of water 106 fills the water reservoir 104. In one example, the float is adjusted to actuate the valve in the off position when 1.6 gallons of water 106 is within the water reservoir 104. In another example, the float is adjusted such that it turns off the water flow when 1.28 gallons of water 106 is in the water reservoir 104. In some circumstances, indicia are provided on the interior of the water reservoir 104, to indicate amount of water. For example, when the water meniscus reaches a first line, the volume of water 106 within the water reservoir 104 is 1.28 gallons. In a further example, when the water meniscus reaches a second line, the volume of water 106 within the water reservoir 104 is 1.3 gallons. Various water volumes can be utilized in accordance with the needs of specific toilet.

At box 182, the actuation subassembly 158 is assembled. Namely, the eyelet 116 is connected to the toilet's flush handle 163, such as via the toilet's chain 165. In some circumstances, the insert is provided with the chain 165 and/or the handle 163.

Once the actuation subassembly 158 has been assembled, the water supply to the toilet is turned back on. The water reservoir 104 fills with water 106, and the device 100 is in condition (e.g., ready) to flush the toilet.

Figure 15:
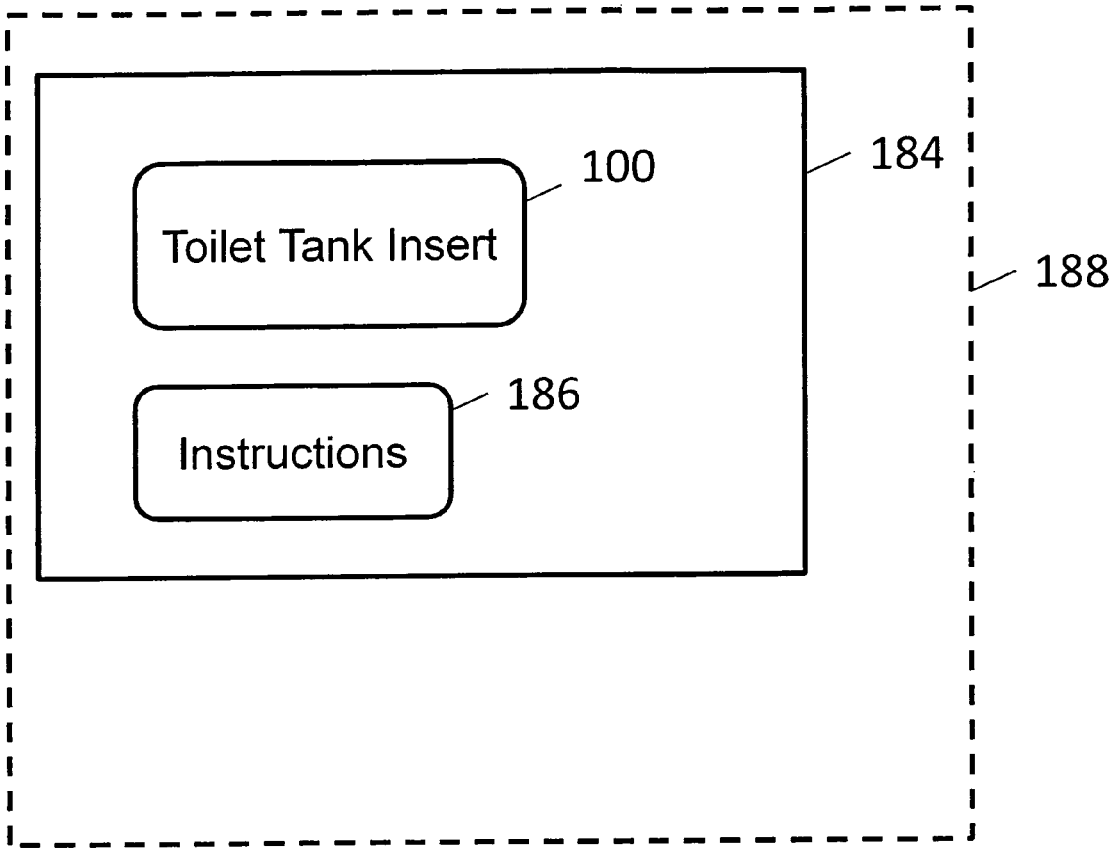
FIG. 15 is a box diagram of a kit including the toilet insert of FIG. 1.

FIG. 15 is a schematic diagram of kits for converting a conventional flush toilet (e.g., with a flapper flush valve system) to a dump bucket-style toilet. A first kit, denoted by the numeral 184, includes a device 100 as described above and with reference to FIGS. 1-13, and a set of instructions 186. The instructions 186 describe a method of installing the device 100, such as the method 172 described above and with reference to FIG. 14. The instructions can further explain how to actuate the device 100, how to adjust the amount of water 106 received into the water reservoir 104, troubleshooting, and the like. A second kit 188 includes the device 100 and the set of instructions 186. The kit 188 may also include an installation tool 190 to facilitate installation or where a specialized tool is required that is unique to the device 100. In some circumstances, disposable tools, such as an amount of plumber's adhesive compound, a small screw driver or an alien wrench is provided with the second kit 188.

The term "comprising" as used herein is synonymous with "including," "containing," or "characterized by," and is inclusive or open-ended and does not exclude additional, unrecited elements or method steps.

All numbers expressing quantities used in the specification and claims are to be understood as being modified in all instances by the term "about." Accordingly, unless indicated to the contrary, the numerical parameters set forth in the specification and attached claims are approximations that can vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

It is to be understood that while certain forms of the present invention have been illustrated and described herein, it is not to be limited to the specific forms or arrangement of parts described and shown.

What is claimed and desired to be secured by Letters Patent is as follows:

1. A tank insert for a toilet, comprising:

a) a water reservoir including a longitudinal axis of rotation, wherein said water reservoir is sized and shaped to receive a quantity of water from a fill valve system of the toilet and having a dump side; and b) a catch basin sized and shaped to be received snugly within a water tank of the toilet and including an upper interior portion adapted to pivotably receive said water reservoir therein, a lower interior portion sized and shaped to receive the quantity of water from said water reservoir, and an inwardly extending splash guard mounted on an interior surface of said catch basin beneath the water reservoir opposite the water reservoir dump side, said splash guard including a concave upper surface and a concave lower surface, said splash guard being adapted to substantially direct water exiting the water reservoir toward said lower interior portion;

c) a mounting subassembly adapted to pivotably attach said water reservoir to said upper interior portion; and d) an actuation subassembly adapted for pivoting said dump side of the water reservoir along said longitudinal axis of rotation, so as to discharge the quantity of water from said water reservoir and into said lower interior portion.

2. The tank insert of claim 1, including a water outlet located in said lower interior portion, wherein said water outlet is adapted for fluid communication between the lower interior portion and a flush channel of the toilet.

3. The tank insert of claim 1, wherein said water reservoir includes an interior defined by a pair of opposed generally upright U-shaped side walls and a facing wall.

4. The tank insert of claim 1, wherein said splash guard is inwardly bowed and has an upper side that is closely spaced from an underside of the water reservoir.

5. The tank insert of claim 1, wherein said concave upper surface includes a curve substantially equal to a curved outer surface of said water reservoir.

6. The tank insert of claim 1, wherein said reservoir is trough-shaped.

7. The tank insert of claim 1, wherein said quantity of water is about 1.6 gallons or less.

8. The tank insert of claim 1, wherein said quantity of water is about 1.28 gallons or less.

9. The tank insert of claim 1, wherein said water reservoir is adapted to discharge an amount of water sufficient to generate a flushing vortex in the toilet.

10. The tank insert of claim 1, wherein said water reservoir is adapted to receive the water from a fill valve and float system of the toilet.

11. The tank insert of claim 1, wherein said mounting subassembly includes:

a) a pair of brackets, each of said brackets being disposed on one of a pair of opposed interior surfaces of said upper interior portion; and b) a pair of trunnions mounted on opposed exterior side surfaces of said water reservoir, said trunnions being disposed coaxially with the longitudinal axis of rotation; and c) wherein each of said trunnions is rotatably engaged in one of said brackets.

12. The tank insert of claim 11, wherein said water reservoir is adapted for discharging the quantity of water into said catch basin upon rotation of said trunnions about said axis of rotation.

13. The tank insert of claim 11, wherein said brackets are integral with said interior surfaces.

14. The tank insert of claim 1, wherein said water reservoir is adapted to pivot from front to rear about said axis of rotation and with respect to the toilet.

15. The tank insert of claim 1, wherein said water reservoir includes a first position associated with receiving the quantity of water and a second position associated with discharging the quantity of water.

16. The tank insert of claim 15, wherein when in the second position said water reservoir is rotated approximately 90° about said axis of rotation with respect to the first position.

17. The tank insert of claim 1, wherein said actuation subassembly includes an eyelet located on a bottom exterior surface of said water reservoir, said eyelet being adapted for attachment to a chain attached to a flush handle of the toilet.

18. The tank insertion of claim 17, wherein said eyelet is adapted for pulling by the chain when the handle is actuated, such that simultaneously a) said eyelet is moved forward and upward with respect to the toilet and b) an upper opening of said water reservoir is tilted rearward and downward with respect to the toilet.

19. The tank insert of claim 1, wherein said catch basin includes:

a) a basin floor having opposed front and rear edges, a pair of opposed side edges, and a water outlet; and b) wherein said basin floor includes at least one slope selected from the group consisting of:

I) a downward slope from at least one of said front, rear and side edges towards an opposed edge; and ii) a downward slope from at least one of said front, rear and side edges towards a central portion of said floor;

c) wherein said water outlet is lower than said basin floor with respect to the toilet.

20. The tank insert of claim 19, wherein said downward slope includes an angle optimized for efficient toilet flushing.

21. The tank insert of claim 19, wherein said basin floor is generally funnel-shaped.

22. A method of converting a toilet with a flapper valve flush system to a flapperless toilet, comprising:

a) removing the flush valve and flapper system from the toilet tank;

b) inserting a dump bucket insert into the toilet tank;

c) fluidly connecting said dump bucket insert to a flush channel of the toilet;

d) fluidly connecting a water reservoir of said dump bucket insert to a fill valve of the toilet; and e) connecting said water reservoir of said dump bucket insert to a flush handle of the toilet, whereby actuation of the flush handle tilts said water reservoir; and f) securing a splash guard to extend outwardly from the tank and beneath the dump bucket wherein the splash guard has an upper concave surface closely spaced with respect to the dump bucket and a lower concave surface.

23. The method of claim 22, wherein step b) of claim 23 includes:

inserting a catch basin into the toilet tank and securing the splash guard to the catch basin; and installing the water reservoir into the catch basin; providing the dump bucket with a curved lower surface such that a curved outer surface of the water reservoir is in spaced relationship an inwardly bowed and closely spacing the dump bucket lower surface to the upper surface of the splash guard.

24. A kit for retrofitting an installed toilet with a flapper valve flush system, said kit comprising:

a) tank insert as recited in claim 1; and b) a set of instructions for performing the method as recited in claim 23.

25. The kit of claim 24, further including an installation tool.

26. A tank insert for a toilet, comprising:

a) a water reservoir including a longitudinal axis of rotation, wherein said water reservoir is sized and shaped to receive a quantity of water from a fill valve system of the toilet and having a dump side; the water reservoir having a lower convex curvature bottom: and b) a catch basin sized and shaped to be received snugly within a water tank of the toilet and including an upper interior portion adapted to pivotably receive said water reservoir therein, a lower interior portion sized and shaped to receive the quantity of water from said water reservoir, and an inwardly extending splash guard mounted on an interior surface of said catch basin beneath and in close proximity to the water reservoir opposite the water reservoir dump side, said splash guard being adapted to substantially direct water exiting the water reservoir toward said lower interior portion; the splash guard has a concave upper surface such that, when the water reservoir is dumped, the water reservoir bottom and the splash guard upper surface are in a mating relationship and closely spaced;

c) a mounting subassembly adapted to pivotably attach said water reservoir to said upper interior portion; and d) an actuation subassembly adapted for pivoting said dump side of the water reservoir along said longitudinal axis of rotation, so as to discharge the quantity of water from said water reservoir and into said lower interior portion.

27. The tank insert according to claim 26 wherein the reservoir bottom and splash guard upper surface both include a partial circular region with the same radius.

* * * * *